US008807677B2

(12) United States Patent
Kumagai et al.

(10) Patent No.: US 8,807,677 B2
(45) Date of Patent: Aug. 19, 2014

(54) PRINTING APPARATUS AND PRINTING METHOD

(71) Applicant: Seiko Epson Corporation, Tokyo (JP)

(72) Inventors: Shiki Kumagai, Shiojiri (JP); Masaru Kumagai, Shiojiri (JP); Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 13/653,891

(22) Filed: Oct. 17, 2012

(65) Prior Publication Data

US 2013/0100186 A1 Apr. 25, 2013

(30) Foreign Application Priority Data

Oct. 25, 2011 (JP) ..... 2011-234236

(51) Int. Cl.
*B41J 29/38* (2006.01)
*B41J 2/21* (2006.01)

(52) U.S. Cl.
USPC ..... 347/9; 347/12; 347/14; 347/43; 347/103; 347/104; 358/1.8; 358/1.9

(58) Field of Classification Search
USPC ..... 347/9, 12, 14, 43, 103, 104; 358/1.8, 358/1.9
See application file for complete search history.

(56) References Cited

U.S. PATENT DOCUMENTS

| | | | | |
|---|---|---|---|---|
| 6,428,143 | B2 | 8/2002 | Irihara et al. | |
| 6,552,820 | B1 * | 4/2003 | Hill | 358/1.8 |
| 7,794,077 | B2 * | 9/2010 | Falser et al. | 347/104 |
| 8,506,033 | B2 * | 8/2013 | Sano | 347/12 |
| 2001/0020964 | A1 | 9/2001 | Irihara et al. | |
| 2009/0081423 | A1 | 3/2009 | Sano | |

FOREIGN PATENT DOCUMENTS

| | | |
|---|---|---|
| JP | 2001-246767 | 9/2001 |
| JP | 2009-056613 | 3/2009 |

* cited by examiner

*Primary Examiner* — Anh T Vo
(74) *Attorney, Agent, or Firm* — Workman Nydegger

(57) ABSTRACT

A printing apparatus includes a first part of nozzles that ejects at least one of brilliant ink and white ink to a medium, a second part of nozzles that ejects color ink to the medium, and a control unit that forms a first image by the first part of nozzles and forms a second image on the first image by the second part of nozzles, and deforms, when a part of an edge of the first image and a part of an edge of the second image are overlapped before forming the image on the medium, at least one of the first image and the second image so that a portion of the overlapped edge in the second image is positioned outside a portion of the overlapped edge in the first image.

9 Claims, 9 Drawing Sheets

BEFORE DEFORMATION

AFTER DEFORMATION

BEFORE DEFORMATION

AFTER DEFORMATION

PRINTING APPARATUS AND PRINTING METHOD

BACKGROUND

The entire disclosure of Japanese Patent Application No. 2011-234236, filed Oct. 25, 2011 is expressly incorporated by reference herein.

1. Technical Field

The present invention relates to a printing apparatus and a printing method.

2. Related Art

An ink jet printer that performs printing by ejecting a plurality of kinds of ink to a medium has been developed. In such a printer, printing is performed in such a manner that once an image of a lower layer is formed using any ink, a color image is formed on the image of the lower layer.

In JP-A-2001-246767, recording of white ink is shown prior to recording of quick-drying ink. In addition, a part of both may be shifted. In JP-A-2009-56613, recording of the white ink, used in the base, on a large area is shown.

There is a case in which colored metallic printing is performed by ejecting a color ink on ink (metallic ink) having a metallic luster. In such a printing, in a case in which an edge of an image by the metallic ink and an edge of an image by the color ink should be aligned with each other, unless an image is formed by ejecting ink so as to align both in an accurate manner, a metallic image of a lower layer protrudes from a color image. The metallic ink is more visually conspicuous than the color ink, and therefore an image quality is significantly reduced when the metallic ink partially protrudes at the edges of the image.

SUMMARY

An advantage of some aspects of the invention is to prevent an image of a lower layer from protruding at overlapped portions of the edges to thereby suppress a reduction in image quality.

According to an aspect of the invention, there is provided a printing apparatus including: a first part of nozzles that ejects at least one of brilliant ink and white ink to a medium; a second part of nozzles that ejects color ink to the medium; and a control unit that forms a first image by the first part of nozzles and forms a second image on the first image by the second part of nozzles, and when a part of an edge of the first image and a part of an edge of the second image are overlapped before forming the image on the medium, deforms at least one of the first image and the second image so that a portion of the overlapped edge in the second image is positioned outside a portion of the overlapped edge in the first image.

Other features of the invention will become apparent from descriptions of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
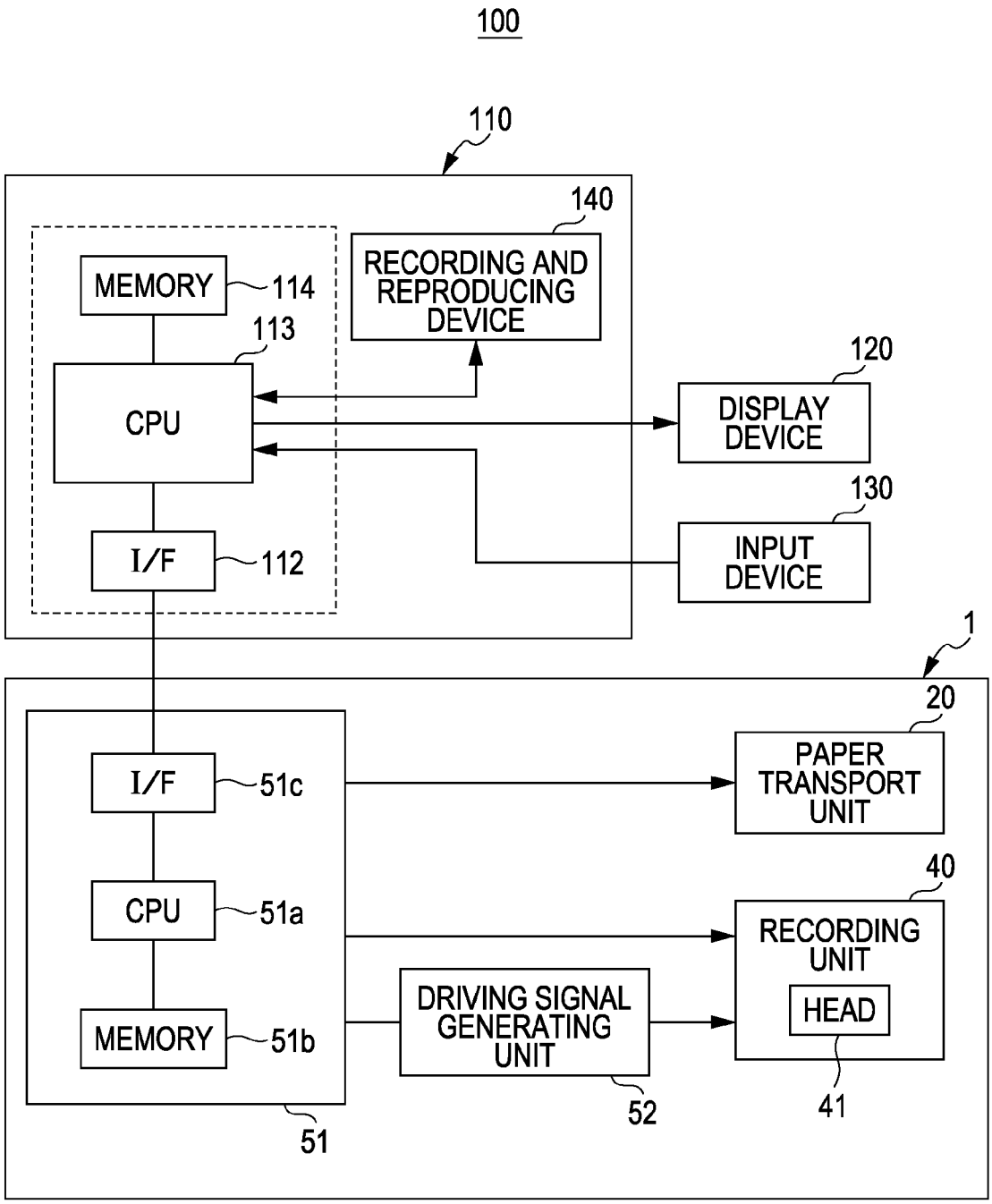
FIG. 1 is a block diagram showing a printing system according to a first embodiment of the invention.

At least the following will be apparent by the descriptions of the present specification and the accompanying drawings. That is, the invention relates to a printing apparatus that includes a first part of nozzles that ejects at least one of brilliant ink and white ink to a medium, a second part of nozzles that ejects color ink to the medium, and a control unit that forms a first image by the first part of nozzles and forms a second image on the first image by the second part of nozzles, and deforms, when a part of an edge of the first image and a part of an edge of the second image are overlapped before forming the image on the medium, at least one of the first image and the second image so that a portion of the overlapped edge in the second image is positioned outside a portion of the overlapped edge in the first image.

In this manner, in the first image formed on a lower layer and the second image formed on an upper layer, when the parts of the edges are overlapped with each other, the images are deformed so that the edge of the second image is positioned outside the edge of the first image, and then the images are formed, and therefore a reduction in an image quality may be suppressed by preventing the first image of the lower layer from protruding in the overlapped portions of the edges.

In the printing apparatus, it is preferable that the deformation of the at least one of the first image and the second image be a reduction in the first image.

In this manner, the second image becomes larger than the first image, and then the second image is formed on the first image, and therefore the first image is prevented from protruding from the second image, thereby suppressing the reduction in the image quality.

In addition, it is preferable that the reduction of the first image be performed in such a manner that the edge of the first image is detected, and the detected edge is moved so as to reduce the area of the first image.

In this manner, specifically, the first image may become smaller than the second image.

In addition, the deformation of the at least one of the first image and the second image may be a magnification of the second image.

In this manner, the second image may become larger than the first image, and then the second image is formed on the first image, and therefore ink of the first image is prevented from protruding from the second image, thereby suppressing the reduction in the image quality.

In addition, it is preferable that the magnification of the second image be performed in such a manner that the edge of the second image is detected, and the detected edge is moved so as to increase the area of the second image.

In this manner, specifically, the second image may become larger than the first image.

In addition, the deformation of the at least one of the first image and the second image may be a deformation in which an ejection amount of the color ink at an edge portion of the second image is reduced further than that at a center portion of the second image.

In this manner, even when the at least one of the first image and the second image is deformed, the amount of the ink at the edges is gradually reduced, and therefore the deformation may be made inconspicuous.

In addition, the medium may be transported in a transport direction. In addition, the first part of nozzles and the second part of nozzles may be included in a head moving in an intersection direction intersecting the transport direction, and the first part of nozzles may be provided on the upstream side of the head from the second part of nozzles in the transport direction. In addition, the deformation of the at least one of the first image and the second image may be a deformation in the transport direction when the transport of the medium in the transport direction and the movement of the head in the intersecting direction are repeated to thereby form the first image and the second image.

In the head, in a case of the printing apparatus in which the first part of nozzles is disposed on the upstream side from the second part of nozzles in the transport direction, it is thought that the first image and second image are more often formed shifted in the transport direction than in the direction intersecting the transport direction. Accordingly, in the configuration described above, the image may be deformed only in a transport direction in which displacement between the first image of the lower layer and the second image of the upper layer easily occurs, and therefore it is possible to minimize a change in the image size due to the deformation, thereby reducing a consumption amount of ink.

In addition, at least the following will be also apparent by the descriptions of the present specification and the accompanying drawings. That is, the invention relates to a printing method that includes, in a first image formed by ejecting at least one of brilliant ink and white ink and a second image formed on the first image by ejecting color ink, when a part of an edge of the first image and a part of an edge of the second image are overlapped, deforming at least one of the first image and the second image so that a portion of the overlapped edge in the second image is positioned outside a portion of the overlapped edge in the first image, and forming the second image on the first image by forming the first image and the second image of which at least one is deformed.

In this manner, when the parts of the edges are overlapped with each other in the first image formed on a lower layer and the second image formed on the upper layer, the image is deformed so that the edge of the second image is positioned outside the edge of the first image, and then the image is formed, and therefore a reduction in an image quality may be suppressed by preventing the first image of the lower layer from protruding at the overlapped portions of the edges.

Embodiments

FIG. 1 is a block diagram showing a printing system 100 according to a first embodiment of the invention. Hereinafter, a schematic configuration of the printing system 100 according to the first embodiment will be described with reference to FIG. 1.

The printing system 100 includes an ink jet printer (hereinafter, may simply referred to as a "printer 1") as a printing apparatus, a computer 110, a display device 120, and an input device 130. The printer 1 prints an image on a medium such as paper, fiber, film, or the like. The computer 110 is communicably connected to the printer 1 through an interface 112. Since an image is printed by the printer 1, the computer 110 outputs printing data corresponding to the image to the printer 1. The computer 110 includes a CPU 113, a memory 114, an interface 112, and a recording and reproducing device 140. A computer program such as an application program or a printer driver is installed. The recording and reproducing device 140 is, for example, a flexible disk drive device or a CD-ROM drive device.

The display device 120 is, for example, a liquid crystal monitor. The display device 120 is used to display, for example, a user interface of a computer program. The input device 130 is, for example, a keyboard or a mouse.

The ink jet printer 1 includes a paper transport unit 20, a recording unit 40, a control unit 51, and a driving signal generating unit 52. The paper transport unit 20 supplies a medium such as paper S from a rolled paper R to the recording unit 40, and discharges the paper S after printing. The recording unit 40 moves a carriage 43 on which a head 41 is mounted, and ejects ink from the head 41 to thereby form an image on the medium, as will be described below.

In addition, the ink jet printer 1 includes the control unit 51 for controlling overall operations of each component described above. The control unit 51 includes a CPU 51*a* for performing an operation or the like, a memory 51*b* for storing a program, an operation result, or the like, and an interface 51*c* for performing communication with an external device. The control unit 51 controls the paper transport unit 20, the recording unit 40, and the driving signal generating circuit 52.

The driving signal generating unit 52 supplies a driving signal COM to each piezoelectric element (PZT, which will be described below) of the head 41 of the recording unit 40. Digital data for regulating the shape of a driving signal is transmitted from the control unit 51 to the driving signal generating unit 52, so that the driving signal COM that is a voltage waveform is generated based on the digital data.

Figure 2:
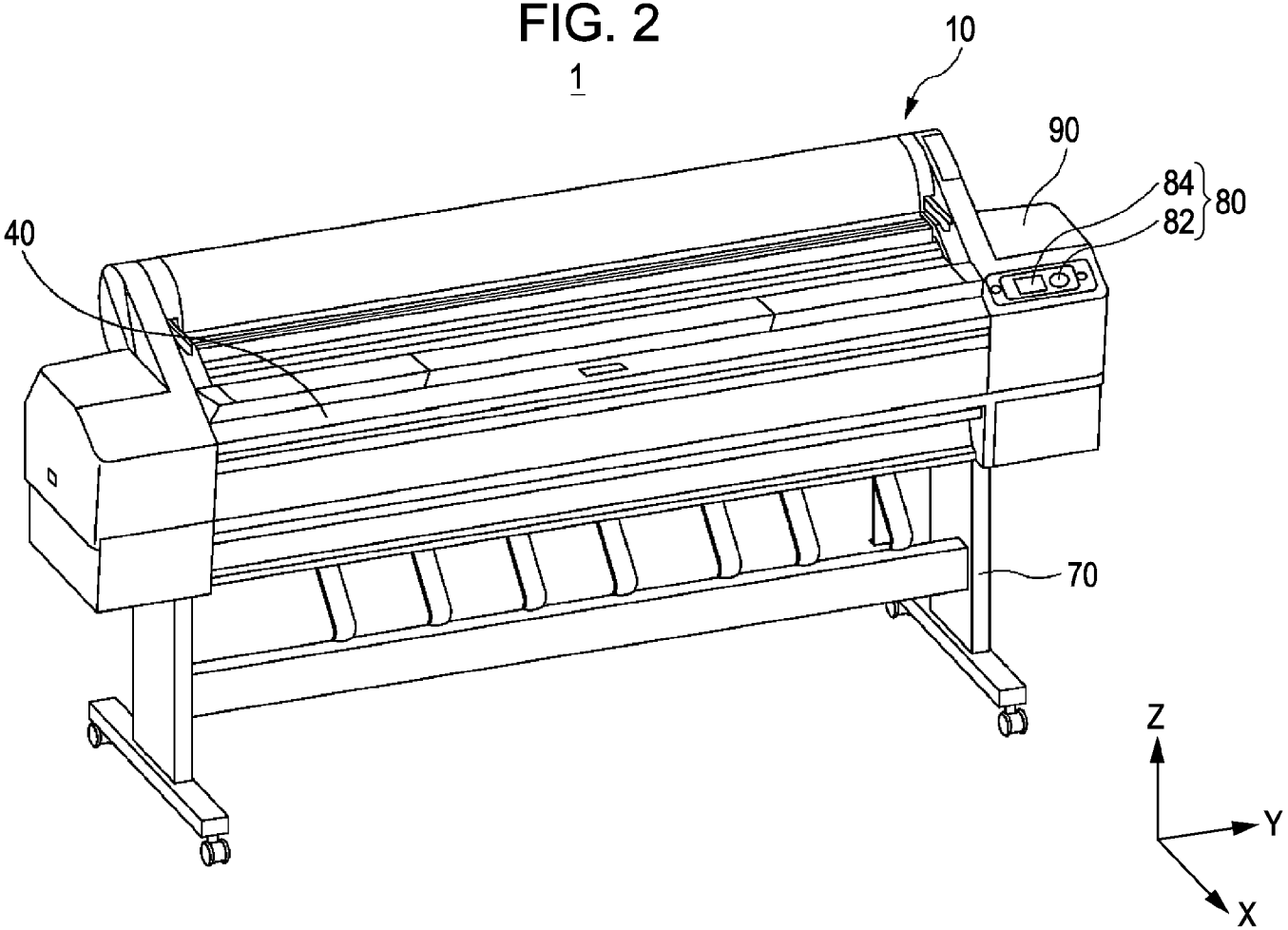
FIG. 2 is a perspective view showing an ink jet printer according to a first embodiment.
Figure 3:
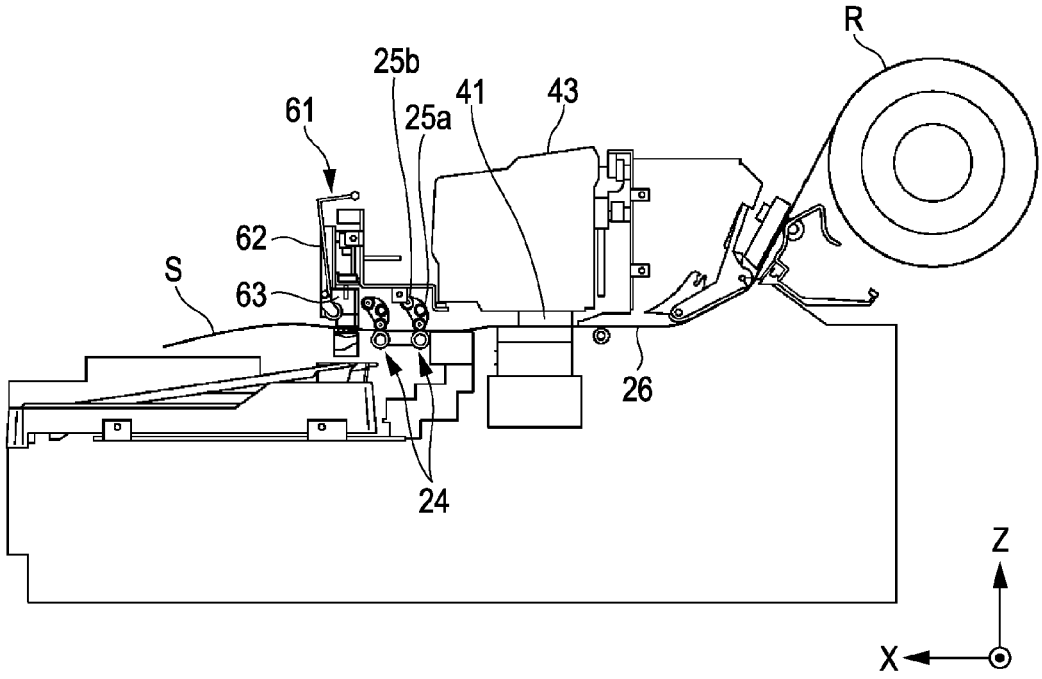
FIG. 3 is an interior view showing an ink jet printer according to a first embodiment.

FIG. 2 is a perspective view showing an ink jet printer 1 according to a first embodiment, and FIG. 3 is an interior view showing an ink jet printer 1 according to a first embodiment. In the following description, the transport direction (a discharge direction) of the medium may be referred to as the X-axis direction, the width direction (a vertical direction on a page in FIG. 3) of the transport path 26 which intersects the X-axis direction may be referred to as the Y-axis direction, and a vertical direction perpendicular to the X-axis direction and the Y-axis direction may be referred to as the Z-axis direction.

As shown in FIG. 2, the ink jet printer 1 includes the recording unit 40 whose longitudinal direction is disposed horizontally, a housing 90 that is mounted on an end portion of the recording unit 40, a loading portion 10 that is mounted on the upper side of the recording unit 40, and a leg portion 70 that supports the recording unit 40 and the housing 90 from below.

The recording unit 40 includes the head 41 for ejecting ink to a medium that is transported along the transport path 26. The head 41 is mounted on the carriage 43 that is a movement member, in the width direction of the transport path 14. An ink cartridge (not shown) for storing ink is mounted on the carriage 43. The head 41 includes a plurality of nozzle rows, and ejects ink of each predetermined color (for example, yellow (Y), magenta (M), cyan (C), black (K), metallic (Me) (or white (W)) from the plurality of nozzle rows. The head 41 may perform image formation for recording information such as predetermined images, characters, or the like by ejecting ink to the recording surface of a medium.

The medium on which the image formation is performed in the recording unit 40 is discharged from a discharge roller 24. The discharge roller 24 has a mechanism for converting a roller for nipping into a giza roller 25*a* or a roll roller 25*b* according to the kind of paper.

On the downstream side of the discharge roller 24, a cutter device 61 for cutting the discharged medium into a predetermined size is provided. The cutter device 61 includes a regulating member 62 for regulating the height position of the discharged medium and a cutter unit 63 that is moved in the width direction (Y-axis direction) perpendicular to the discharge direction (X-axis direction) of the medium so as to cut the medium.

An operation panel 80 is disposed on the upper surface of the housing 90. The operation panel 80 includes a display unit 84 for displaying an operational state of the printer 1 in addition to a plurality of switches 82 which are operated by a user. Accordingly, the user operates the printer 1 from a front surface side using a side where the operation panel 80 and the cartridge holder are disposed, as the front surface side.

Figure 4:
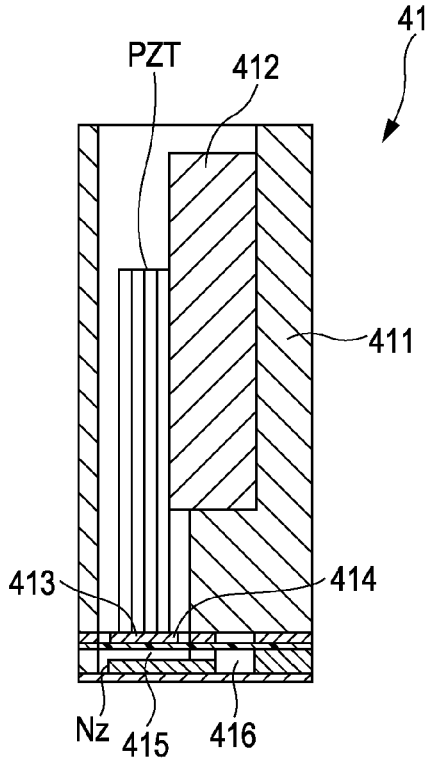
FIG. 4 is a cross-sectional view showing a structure of a head.

FIG. 4 is a cross-sectional view showing a structure of a head 41. A flow passage 416 is formed in the head 41, and ink is supplied through the flow passage 416. An adhesive substrate 412 is fixed to a case 411 of the head 41. The adhesive substrate 412 is a rectangular plate, and a piezoelectric element (PZT) is adhered to one surface of the adhesive substrate 412. An island portion 413 is joined to the distal end of the piezoelectric element (PZT), and an elastic region formed by an elastic film 414 is around periphery of the island portion 413.

The piezoelectric element (PZT) is deformed by applying a potential difference between electrodes facing each other. In this example, the piezoelectric element (PZT) is expanded and contracted in the longitudinal direction thereof. An amount of the expansion and contraction is determined according to a potential of the piezoelectric element (PZT). When the piezoelectric element (PZT) is expanded or contracted, the island portion 413 is pushed to a pressure chamber 415 or drawn in the opposite direction. In this instance, since the elastic film 414 in the vicinity of the island portion is deformed, ink may be efficiently ejected from a nozzle Nz.

By adopting the configuration described above, ink having a plurality of sizes may be ejected by adjusting amplitude of a driving signal applied to the piezoelectric element (PZT). In the first embodiment, small dots, medium dots, and large dots may be formed.

Figure 5:
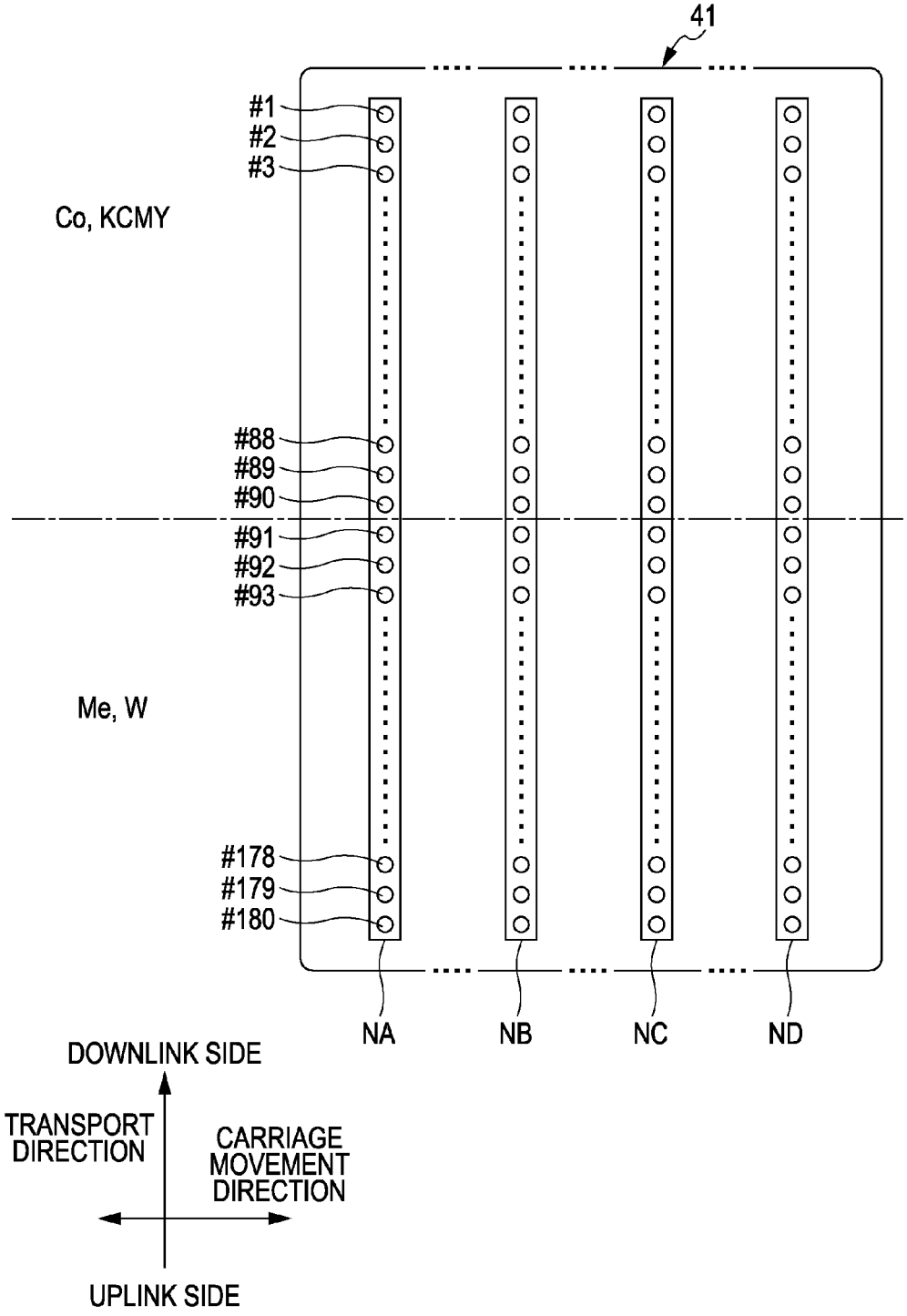
FIG. 5 is an explanatory diagram showing a nozzle of a head.

FIG. 5 is an explanatory diagram showing a nozzle of the head 41. Five kinds of ink such as yellow ink (Y), magenta ink (M), cyan ink (C), black ink (K), and metallic ink (Me) may be ejected from the head 41 according to the first embodiment. In addition, a nozzle for ejecting the metallic ink (Me) may be used as a nozzle for ejecting white ink (W).

The metallic ink (Me) contains a metallic pigment and an organic solvent. The metallic pigment is not particularly limited as long as it has metallic gloss or the like, but it is desirable that aluminum or an aluminum alloy, or silver or a silver alloy be used. Among these, in terms of costs and achievement of high metallic gloss, aluminum or an aluminum alloy is preferably used. When the aluminum alloy is used, other metal elements or nonmetallic elements to be added to aluminum are not particularly limited as long as they have metallic gloss or the like. Here, silver, gold, platinum, nickel, chromium, tin, zinc, indium, titanium, copper, and the like may be used, and at least one of a single metal, an alloy, and a mixture thereof may be appropriately used. In the first embodiment, silver is used as the metallic pigment. In addition, metallic ink is included in brilliant ink. In the metallic ink, the contained pigment is not limited to the metallic pigment described above, and any pigment may be used as long as it has metallic gloss.

In addition, the white ink (W) is white colored ink. In the first embodiment, the white ink (W) as ink different from color ink (Co) (YMCK) is distinguished from other kinds of ink.

In the drawings, four nozzle rows are shown. Among these nozzles, a nozzle on the downstream side ejects color ink. A nozzle on the upstream side ejects metallic ink (Me).

Specifically, nozzles #1 to #90 of A nozzle row NA eject black ink (K). Nozzles #91 to #180 of A nozzle row NA eject metallic ink (Me). In the same manner, nozzles #1 to #90 of B nozzle row NB eject cyan ink (C). Nozzles #91 to #180 of B nozzle row NB eject metallic ink (Me).

In the same manner, nozzles #1 to #90 of C nozzle row NC eject magenta ink (M). Nozzles #91 to #180 of C nozzle row NC eject metallic ink (Me). In the same manner, nozzles #1 to #90 of D nozzle row ND eject yellow ink (Y). Nozzles #91 to #180 of D nozzle row ND eject metallic ink (Me).

By adopting the configuration described above, at least the metallic ink (Me) is ejected to the medium, and then color ink is ejected thereon. In addition, as described-above, white ink (W) may be ejected from the nozzles #91 to #180 of each nozzle row, and in this case, at least the white ink (W) is ejected to the medium, and then color ink is ejected thereon.

In addition, unlike a method of dividing the nozzle rows of the same head in this manner, a method of ejecting the metallic ink (Me) and the color ink by arranging a plurality of different heads may be adopted.

Figure 6:
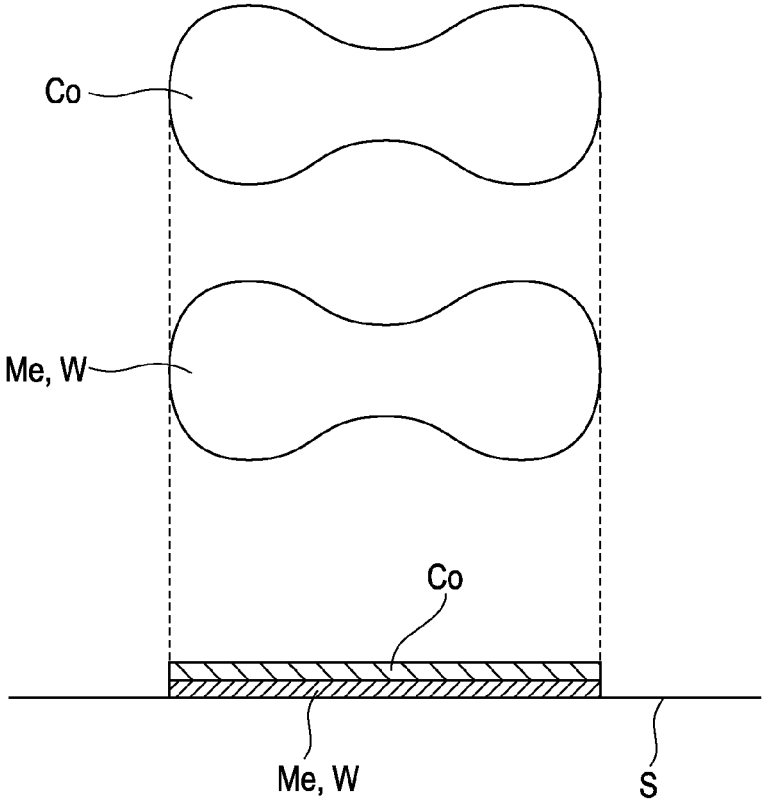
FIG. 6 is an explanatory diagram showing a state in which an edge of a metallic image and an edge of a color image are overlapped.

FIG. 6 is an explanatory diagram showing a state in which the edge of a metallic image and the edge of a color image are overlapped. In the drawing, an image (hereinafter, referred to as a "color image") by color ink (Co) and an image (hereinafter, referred to as a "metallic image") by metallic ink (Me) are shown. Here, for convenience of description, shapes of the color image and the metallic image are the same. Edges of the metallic image and the color image are overlapped so as to be aligned with each other. By performing such printing, metallic printing of colors may be performed.

In a case of printing such images, when a transport error and an error of an ink ejection direction do not occur at the time of transport, the color image and the metallic image are reliably overlapped with each other, and therefore a part of the metallic image is prevented from protruding from the color image.

However, when there is an eccentricity in a roller for carrying out transporting the medium at the time of transport, the transport error in the transport direction may occur. In the head according to the first embodiment, since nozzles on an upstream side of the head eject metallic ink, and nozzles on a downstream side thereof eject color ink, and therefore a relative error may be generated between a landing position of the metallic ink and a landing position of the color ink when the transport error is generated due to the eccentricity.

In particular, in a case in which the metallic image is printed while the medium is transported by first transport, the medium is reversely transported in a direction opposite to the transport direction, and the color image is printed while the medium is transported by second transport, it is considered that the transport error become large due to the large number of transport operations.

In addition, when the roller for carrying out transporting is not a perfect cylindrical form, the medium during transporting slightly causes displacement even in a direction intersecting the transport direction, and therefore a so-called meandering phenomenon may occur. In this manner, even when meandering occurs, a relative error may occur between a landing position of the metallic ink and a landing position of the color ink.

In this manner, when the relative error is generated between the landing position of the metallic ink and the landing position of the color ink, the deviation between an image of a lower layer by the metallic ink and an image of an upper layer by the color ink may occur.

In this instance, on the assumption that the shapes of the metallic image and the color image are the same, as shown in FIG. 6, and the edges of both are reliably overlapped with each other, the image of the lower layer protrudes from the image of the upper layer. In addition, in a case in which the image of the lower image is formed by the metallic ink, when the image of the lower image protrudes from the color image of the upper layer, the protrusion is visually conspicuous, resulting in a reduction in an image quality.

In the embodiments which will be described below, a method of suppressing the reduction in the image quality is provided.

Figure 7:
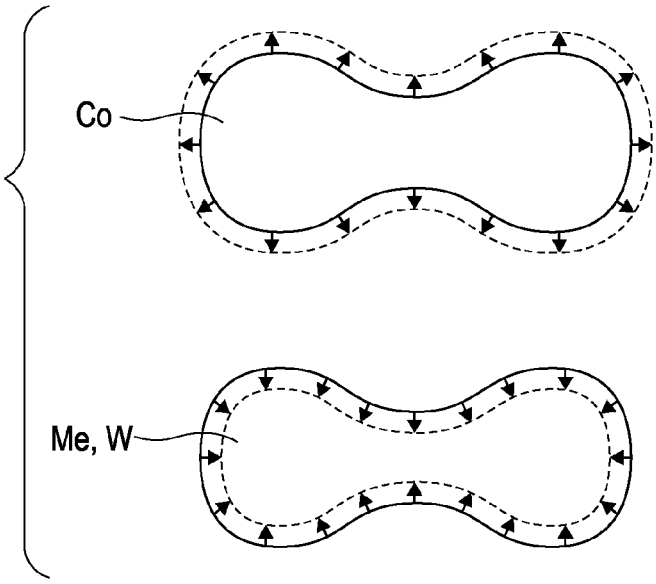
FIG. 7 is an explanatory diagram showing a magnification and reduction process of an image.

FIG. 7 is an explanatory diagram showing a magnification and reduction process of an image. In the first embodiment, as described above, the metallic image by the metallic ink (Me) is formed on the medium, and the color image by the color ink (Co) is formed on the metallic ink. In addition, a white image by white ink (W) which is different from the metallic image by the metallic ink (Me) may be formed on the lower layer.

Even when a deviation between the metallic image of the lower layer and the color image of the upper layer occurs due to the transport error or the like, in order to prevent the metallic image overlapped with the color image from protruding, one of a reduction process in which an edge of the metallic image of the lower layer is reduced to the inside of the edge of the color image, and a magnification process in which an edge of the color image of the upper layer is magnified to the outside of the edge of the metallic image, or both may be performed.

When the edge of the color image of the upper layer is magnified to the outside of the edge of the metallic image, the edge of the color image is detected, and a portion of the detected edge is moved in a direction in which the area of the color image is increased (see, an upper figure in FIG. 7).

Meanwhile, when the edge of the metallic image of the lower layer is reduced to the inside of the edge of the color image, the edge of the metallic image is detected, and a portion of the detected edge is moved in a direction in which the area of the metallic image is reduced (see a lower figure in FIG. 7).

Figure 8A:
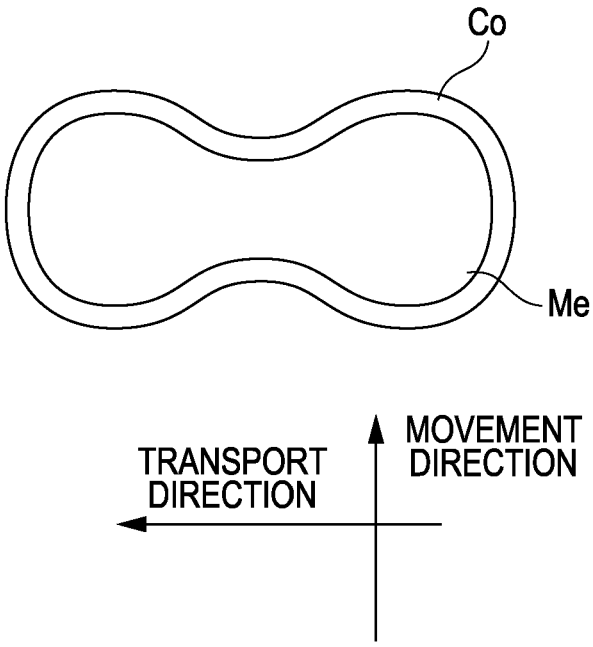
FIG. 8A is a top view showing an image deformation process according to a first embodiment of the invention.
Figure 8B:
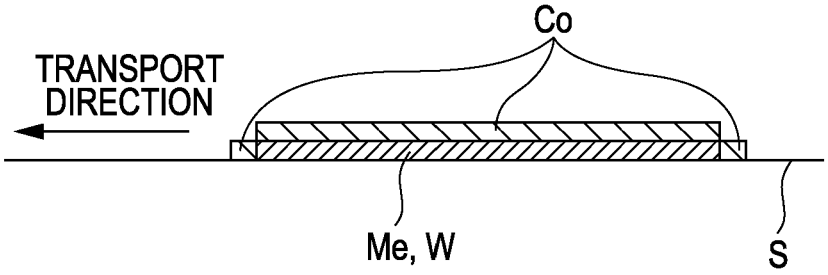
FIG. 8B is a transverse cross-sectional view showing an image deformation process according to a first embodiment of the invention.

FIG. 8A is a top view showing an image deformation process according to a first embodiment of the invention, and FIG. 8B is a transverse cross-sectional view showing an image deformation process according to a first embodiment of the invention. In FIG. 8A, as described above, a state in which the metallic image and the color image are overlapped with each other when the metallic image or the color image is deformed is shown as a top view. FIG. 8B, a state in which both images are overlapped with each other is shown as a transverse cross-sectional view. Such both images originally have the same shape as shown in FIG. 6, and edges of both images are aligned with each other. Such images are deformed by the process described in FIG. 7 as shown in FIGS. 8A and 8B. Next, the color image or the metallic image is deformed so that the metallic image is completely covered on the medium S by ink of the color image.

Figure 9:
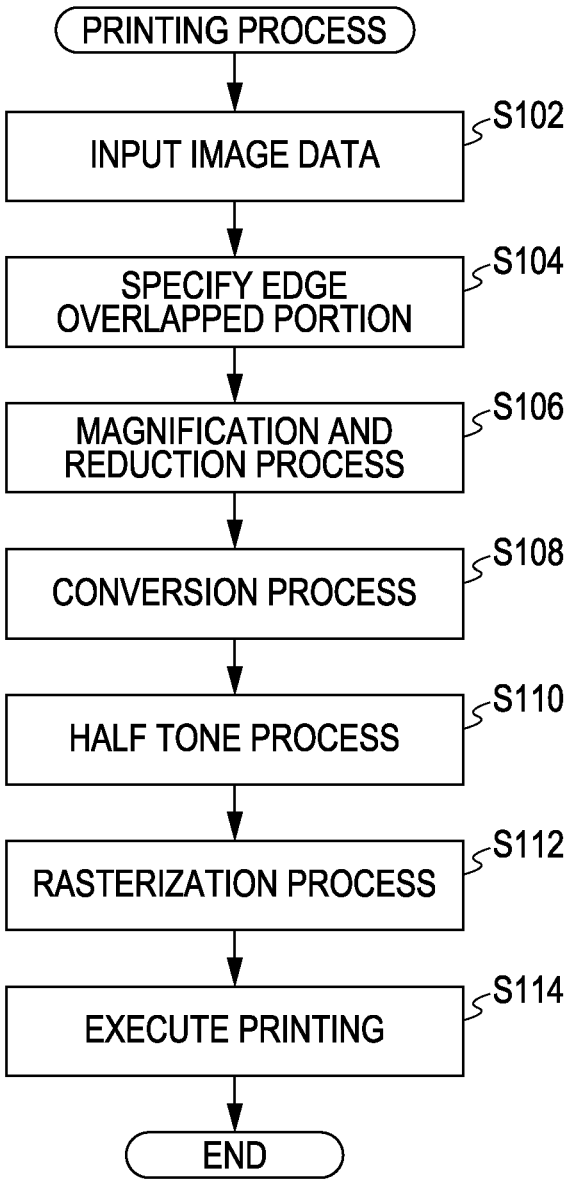
FIG. 9 is a flowchart showing a printing process.

FIG. 9 is a flowchart showing a printing process. Hereinafter, the printing process according to a first embodiment will be described with reference to the flowchart.

First, in step S102, image data is input. The input of the image data is performed in such a manner that an image is created through image software on the computer 110. It is preferable that the image software be able to deal with a metallic layer dealing with the metallic image and a color layer dealing with the color image.

Next, in step S104, a portion in which both the metallic image and the color image are overlapped with each other and edges of both are overlapped with each other is specified. In step S106, a magnification and reduction process is performed with respect to the overlapped edge portion which is specified. The magnification and reduction process may be performed in the same manner as that described above (FIG. 7). In addition, one of the magnification process and the reduction process may be performed, or both thereof may be performed. In addition, when the magnification process is performed, an ink amount of the edge of the color image may be reduced toward the edge.

Next, in step S108, a conversion process of the image data on which the magnification and reduction process are performed is performed. In the conversion process of the image data, a resolution conversion process and a color conversion process are performed. The resolution conversion process is a process in which images of each layer are converted to a resolution at the time of printing. The color conversion process is a process in which each pixel data of each layer of RGB of the color image is converted into image data of a CMYK color space. These processes may be performed by the existing method.

Next, in step S110, a half-tone process is performed with respect to the color image and the metallic image obtained after the conversion process. The half-tone process is a process in which CMYK pixel data and metallic (Me) pixel data are converted into small level of grayscale data that can be expressed by the printer 1. By the half-tone process, the CMYK pixel data indicating, for example, 256 gradations and the metallic (Me) pixel data are converted into data indicating gradation values of four levels (large dots, medium dots, small dots, and no dot). Accordingly, the CMYK pixel data and the metallic (Me) pixel data are converted into data indicating the gradation values of four levels for each ink color.

By the above-described process, with respect to each of cyan ink (C), magenta ink (M), yellow ink (Y), black ink (K), and metallic ink (Me), in which pixel, dots of which size are formed is determined.

Next, in step S112, a rasterization process is performed. The rasterization process is a process in which dot data obtained by the half-tone process is changed to have the order of data to which ink is to be ejected. Next, in step S114, printing is performed by the printer 1 based on data obtained after the rasterization process.

A process after step S104 is performed with respect to a printer driver installed in the computer 110. In this manner, when an image deformation is performed by the printer driver, the control unit 51 and the computer 110 executing the printer drive correspond to the control unit, and when the image deformation is performed only by the control unit 51, the control unit 51 corresponds to the control unit.

In this manner, in a state in which the edge of the metallic image formed on the lower layer and the edge of the color image formed on the upper layer are overlapped with each other, even when positions of the edges are deviated from each other due to transport errors or the like, the edge portions are deformed so that the image formed on the upper layer becomes larger than the image formed on the lower layer, and therefore the image of the lower layer is prevented from protruding. In addition, a reduction in an image quality of the formed image may be suppressed.

Figure 10A:
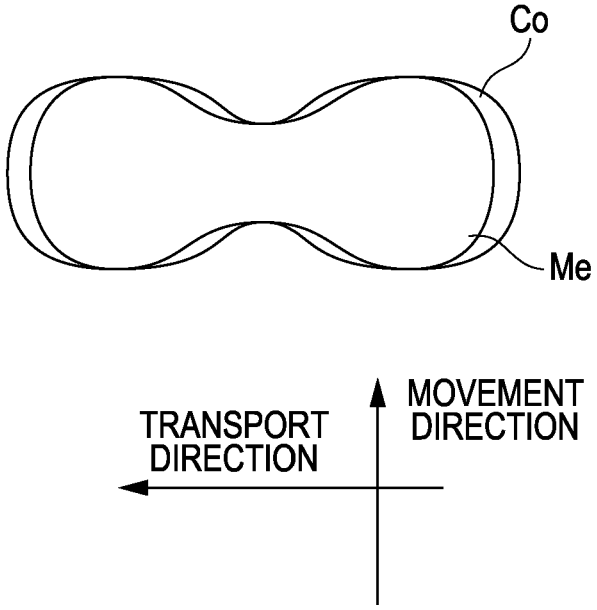
FIG. 10A is a top view showing an image deformation process according to a second embodiment of the invention.
Figure 10B:
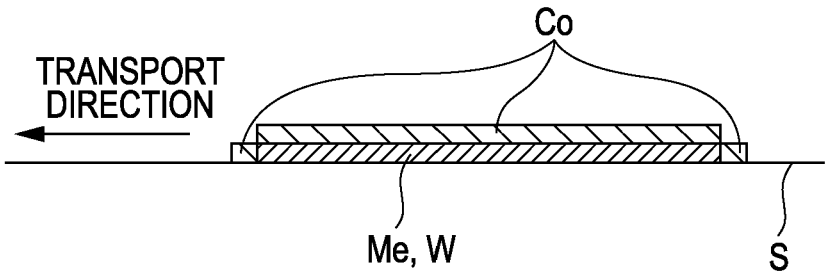
FIG. 10B is a transverse cross-sectional view showing an image deformation process according to a second embodiment of the invention.

FIG. 10A is a top view showing an image deformation process according to a second embodiment of the invention, and FIG. 10B is a transverse cross-sectional view showing an image deformation process according to a second embodiment of the invention. In the first embodiment described above, in order to cope with a case in which a deviation occurs between a landing position of the metallic ink and a landing position of the color ink in the movement direction due to occurrence of an ejection error in the movement direction of the head 41, an example in which the image is deformed even in the movement direction of the head as well as in the transport direction has been described.

However, a case in which the ejection error does not occur in the movement direction of the head 41 (a landing error between color inks in the movement direction of the head is difficult to occur because different color inks (for example, cyan and magenta) are ejected in the same path), and a case in which displacement in the movement direction of the head is very small when transporting the medium may occur. This is because the most of the transport errors of the medium may occur due to eccentricity of the roller for carrying out transporting of the medium. In this case, the image may be deformed only in the transport direction between the metallic image and the color image.

FIG. 10A is a drawing when the color image is deformed only in the transport direction of the medium. FIG. 10B is a cross-sectional view showing a printed matter when printing is performed based on the deformed image data.

In a second embodiment, as shown in FIGS. 10A and 10B, a magnification of the color image and a reduction of the metallic image are not performed in the movement direction of the head 41, and are performed only in the transport direction of the medium.

In this manner, in an environment where there is a possibility of a landing error of ink occurring only in the transport direction of the medium, it is possible to suppress a reduction in an image quality due to protrusion of the metallic image by reducing a consumption amount of the ink as much as possible when magnifying the color image while minimizing influences on the original image due to the deformation of the image.

Figure 11A:
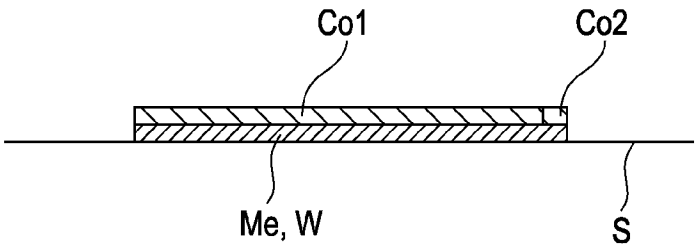
FIG. 11A is a transverse cross-sectional view showing an image before image deformation according to a third embodiment of the invention.
Figure 11B:
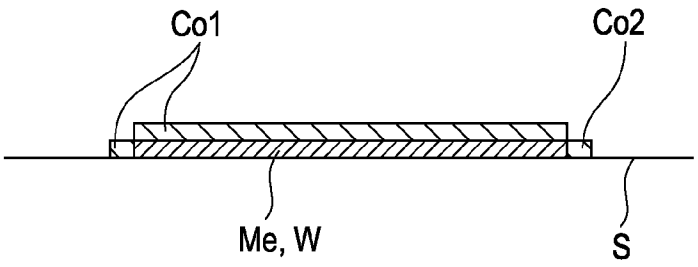
FIG. 11B is a transverse cross-sectional view showing an image after image deformation according to a third embodiment of the invention.

FIG. 11A is a transverse sectional view showing an image before image deformation according to a third embodiment of the invention, and FIG. 11B is a transverse sectional view showing an image after image deformation according to a third embodiment of the invention. The color image according to the above-described first and second embodiments is obtained from color ink of one color or a synthetic color of ink of a plurality of colors. In the third embodiment, a specific case in which the color image which is obtained not by the synthetic color while using the ink of the plurality of colors is formed on the metallic image will be described.

In FIG. 11A, a state in which an image by a first color ink (Co1) (for example, cyan ink (C)) and an image by a second color ink (Co2) (for example, magenta ink (M)) are formed on the metallic image is shown. The image by the first color ink (Co1) and the image by the second color ink (Co2) are not overlapped with each other, and the first color ink (Co1) and the second color ink (Co2) are respectively landed on regions with different metallic images.

In addition, a state in which at least a part of an edge of the image by the first color ink (Co1) and at least a part of an edge of the metallic image are overlapped with each other is shown. In addition, a state in which at least a part of an edge of the image by the second color ink (Co2) and at least a part of an edge of the metallic image are overlapped with each other is shown. The third embodiment is characterized by the image by the second color ink (Co2) being overlapped with only the edge portion of the metallic image.

Even in this case, a case in which edge positions between the image of the lower layer and the image of the upper layer are deviated due to the transport error or the like may occur. Accordingly, in this case, as shown in FIG. 11B, the color image may be magnified, or the metallic image may be reduced. In this case, it is also conceivable that the second color ink (Co2) may not land on the metallic image, however since the reduction in the image quality due to the protrusion of the metallic image from the color image is remarkable, it is possible to deform the original image into an image in which the second color ink (Co2) is not formed on the metallic image, as shown in FIG. 11B.

Figure 12A:
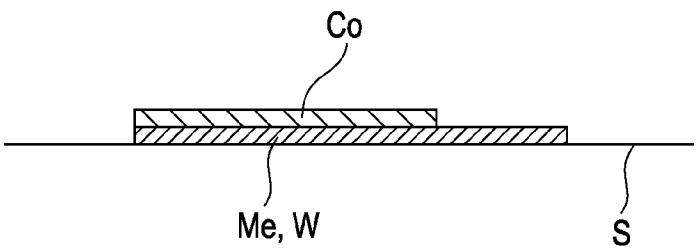
FIG. 12A is a transverse cross-sectional view showing an image before image deformation according to a fourth embodiment of the invention.
Figure 12B:
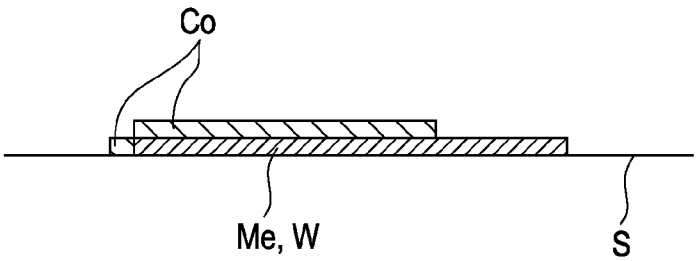
FIG. 12B is a transverse cross-sectional view showing an image after image deformation according to a fourth embodiment of the invention.

FIG. 12A is a transverse sectional view showing an image before image deformation according to a fourth embodiment of the invention, and FIG. 12B is a transverse cross-sectional view showing an image after image deformation according to a fourth embodiment of the invention. As shown in FIG. 12A, a case in which parts of the edges are overlapped with each other, but the color image is formed only on the metallic image may occur. In this case, a case in which the edge positions between the image of the lower layer and the image of the upper layer are deviated from each other due to the transport error or the like may occur. Accordingly, in this case, as shown in FIG. 12B, the color image may be magnified, or the metallic image may be reduced. In this manner, in the edge portion where the metallic image and the color image are overlapped with each other, the edge portion of the metallic image is prevented from protruding from the color image, thereby suppressing a reduction in the image quality.

Other Embodiments

In the above-described embodiments, the printer 1 as the printing apparatus has been described, but the invention is not limited thereto, and may be implemented in a liquid discharging device that can eject or discharge other fluids (a liquid, a liquid material in which a functional material is dispersed, or a fluid such as gel) other than ink. The technology according to the above-described embodiments may be applied to a variety of devices to which the ink jet technologies are applied, such as a color filter manufacturing device, a dyeing device, a fine processing device, a semiconductor manufacturing device, a surface processing device, a three-dimensional molding machine, a gas vaporizer, an organic EL manufacturing device (particularly, a high molecular EL manufacturing device), a display manufacturing device, a film forming device, a DNA chip manufacturing device, and the like. In addition, the method and the manufacturing method which are described above may be in the range of the applications.

The above embodiments are intended to facilitate the understanding of the invention and are not intended to be construed as limiting the invention. It should be noted that the invention may be modified and improved, and include the equivalents thereof without departing from the scope and spirit of the invention.

Head

In the above-described embodiments, ink is discharged using the piezoelectric element. However, a method of discharging a liquid is not limited thereto. For example, other methods such as a method of generating bubbles within the nozzle by heat, and the like may be used.

What is claimed is:

1. A printing apparatus comprising:

a first part of nozzles that ejects at least one of brilliant ink and white ink to a medium;

a second part of the nozzles that ejects color ink to the medium; and a control unit that controls printing to form a first image based on image data by the first part of the nozzles and to form a second image based on the image data on the first image by the second part of the nozzles, and wherein when an overlapped edge portion in which a part of an edge of the first image and a part of an edge of the second image are overlapped exists in the image data, the control unit deforms before forming the image on the medium, at least one of the first image and the second image so that a portion of the edge of the second image including the overlapped edge portion is positioned outside a portion of the edge of the first image including the overlapped edge portion.

2. The printing apparatus according to claim 1, wherein the deformation of the at least one of the first image and the second image is a reduction in the first image.

3. The printing apparatus according to claim 2, wherein the reduction in the first image is performed in such a manner that the edge of the first image is detected and the detected edge is moved so as to reduce an area of the first image.

4. The printing apparatus according to claim 1, wherein the deformation of the at least one of the first image and the second image is a magnification of the second image.

5. The printing apparatus according to claim 4, wherein the magnification of the second image is performed in such a manner that the edge of the second image is detected and the detected edge is moved so as to increase an area of the second image.

6. The printing apparatus according to claim 1, wherein the deformation of the at least one of the first image and the second image is a deformation in which an ejection amount of the color ink at an edge portion of the second image is reduced than that at a center portion of the second image.

7. The printing apparatus according to claim 1, wherein the medium is transported in a transport direction, the first part of nozzles and the second part of nozzles are included in a head moving in an intersecting direction intersecting the transport direction, and the first part of nozzles is provided on an upstream side of the head from the second part of nozzles in the transport direction, and the deformation of the at least one of the first image and the second image is a deformation in the transport direction when the transport of the medium in the transport direction and the movement of the head in the intersecting direction are repeated to thereby form the first image and the second image.

8. The printing apparatus according to claim 1, wherein, when a portion where the first image and the second image are overlapped and a portion where the first image and the second image are not overlapped are present before forming the image on the medium, the control unit deforms at least one of the first image and the second image with respect to the portion where the first and second images are overlapped and does not deform the first image or the second image with respect to the portion where the first and second images are not overlapped.

9. A printing method comprising:

in a first image based on image data formed by ejecting at least one of brilliant ink and white ink and a second image based on the image data formed on the first image by ejecting color ink, when an overlapped edge portion in which a part of an edge of the first image and a part of an edge of the second image are overlapped, deforming at least one of the first image and the second image so that a portion of the edge of the second image including the overlapped edge portion is positioned outside a portion of the edge of the first image including the overlapped edge portion; and forming the second image on the first image by forming the first image and the second image of which at least one is deformed.

* * * * *